US008978596B2

(12) United States Patent
Glassford

(10) Patent No.: US 8,978,596 B2
(45) Date of Patent: Mar. 17, 2015

(54) POWERTRAIN COOLING SYSTEM WITH COOLING FLOW MODES

(75) Inventor: Daniel B. Glassford, Dryden, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 264 days.

(21) Appl. No.: 13/537,137

(22) Filed: Jun. 29, 2012

(65) Prior Publication Data

US 2014/0000536 A1 Jan. 2, 2014

(51) Int. Cl.
*F01P 7/14* (2006.01)

(52) U.S. Cl.
CPC ..... *F01P 7/14* (2013.01)
USPC ..... 123/41.08; 123/41.05; 123/41.29; 236/34.5; 165/203; 165/288; 165/297

(58) Field of Classification Search
CPC ..... F01P 3/02; F01P 3/20; F01P 7/14; F01P 11/08; F28F 27/02; B60H 1/00
USPC ..... 123/41.02, 41.05, 41.08, 41.29, 41.31, 123/41.33, 41.44, 188.1, 196 AB, 198 C; 236/34.5; 165/202, 203, 287, 288, 297
See application file for complete search history.

(56) References Cited

U.S. PATENT DOCUMENTS 3,211,374 A * 10/1965 Matulaitis ..... 237/8 R
3,877,443 A * 4/1975 Henning et al. ..... 123/41.08
4,319,547 A * 3/1982 Bierling ..... 123/41.29
4,381,736 A * 5/1983 Hirayama ..... 123/41.1
5,505,164 A * 4/1996 Hollis ..... 123/41.1
6,098,576 A * 8/2000 Nowak et al. ..... 123/41.33
6,899,162 B2 * 5/2005 Hohl et al. ..... 165/41
6,955,141 B2 * 10/2005 Santanam et al. ..... 123/41.08
7,168,398 B2 * 1/2007 Ap et al. ..... 123/41.1
8,146,542 B2 * 4/2012 Cattani et al. ..... 123/41.29
8,181,610 B2 * 5/2012 Dipaola et al. ..... 123/41.1
8,413,434 B2 * 4/2013 Prior et al. ..... 60/320
2010/0186684 A1 * 7/2010 Utsuno ..... 123/41.1
2011/0088378 A1 4/2011 Prior et al.
2011/0099989 A1 5/2011 Prior et al.
2011/0214627 A1 * 9/2011 Nishikawa et al. ..... 123/41.02

* cited by examiner

*Primary Examiner* — Noah Kamen
*Assistant Examiner* — Grant Moubry
(74) *Attorney, Agent, or Firm* — Quinn Law Group, PLLC

(57) ABSTRACT

A powertrain cooling system includes a coolant pump and coolant flow passages. A first three-position valve is operatively connected with an outlet of the coolant pump and has a first, a second, and a third position to at least partially establish different coolant flow modes through the coolant flow passages. Coolant flow from the coolant pump is blocked from both the cylinder head and the engine block in a first coolant flow mode when the three-position valve is in the first position. Coolant flow from the coolant pump is provided to the cylinder head and is blocked from the engine block in a second coolant flow mode when the three-position valve is in the second position. Coolant flows from the coolant pump to the engine block and from the engine block to the cylinder head in a third coolant flow mode when the three-position valve is in the third position.

11 Claims, 6 Drawing Sheets

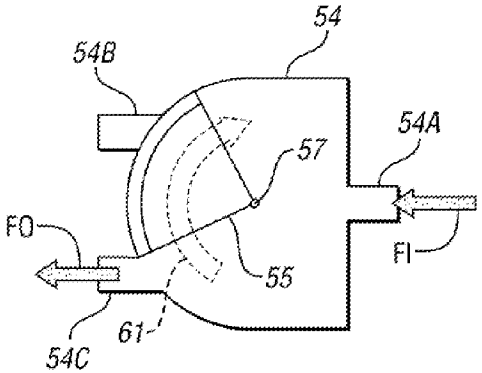
FIG. 6
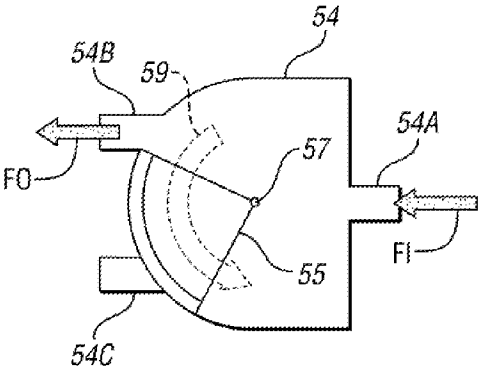
FIG. 7
FIG. 8
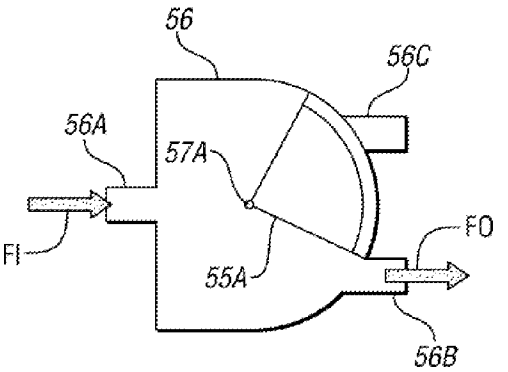
FIG. 9
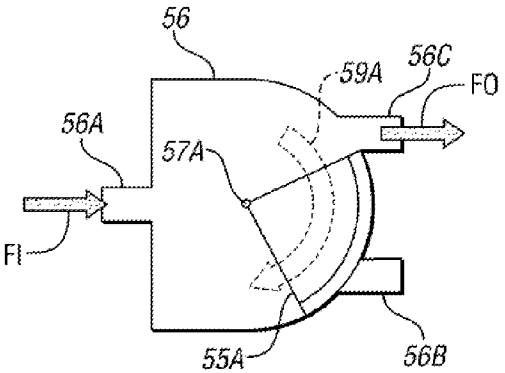
FIG. 10
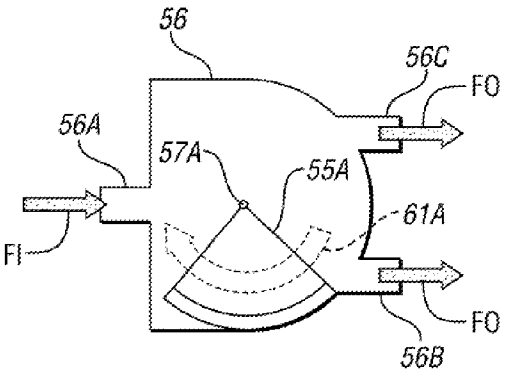
FIG. 11

POWERTRAIN COOLING SYSTEM WITH COOLING FLOW MODES

TECHNICAL FIELD

The present teachings generally include a powertrain cooling system and a method for cooling a powertrain.

BACKGROUND

Rapid warm-up of engine coolant, engine oil and transmission oil after a cold start can improve vehicle fuel economy. A cold start is a start-up of the vehicle when the vehicle has not been running and the engine and transmission are relatively cold. Engine warm-up is especially challenging for diesel and hybrid applications, as less fuel is burned.

SUMMARY

A powertrain cooling system is configured to allow rapid warm-up of powertrain components and fluids, improving fuel economy by reducing frictional losses. The powertrain cooling system includes a coolant pump and a plurality of coolant flow passages. A first three-position valve is operatively connected with an outlet of the coolant pump and has a first, a second, and a third position to at least partially establish different coolant flow modes through the coolant flow passages. Coolant flow from the coolant pump is blocked from both the cylinder head and the engine block in a first of the coolant flow modes when the three-position valve is in the first position. Coolant flow from the coolant pump is provided to the cylinder head and is blocked from the engine block in a second of the coolant flow modes when the three-position valve is in the second position. Coolant flows from the coolant pump to the engine block and from the engine block to the cylinder head in a third of the coolant flow modes when the three-position valve is in the third position.

Accordingly, warming of the cylinder head and the engine block can be separately controlled. For example, a controller can be operatively connected to the first three-position valve and to temperature sensors. A first temperature sensor can be positioned in thermal communication with the cylinder head and with the controller to indicate a cylinder head temperature. A second temperature sensor can be positioned in thermal communication with the engine block and operatively connected to the controller to indicate an engine block temperature. The controller can be configured to (i) place the first three-position valve in the first position when the first temperature sensor indicates the cylinder head temperature is less than a first predetermined temperature, (ii) place the first three-position valve in the second position when the first temperature sensor indicates that the cylinder head temperature is greater than the first predetermined temperature and the engine block temperature is less than a second predetermined temperature; and (iii) place the first three-position valve in the third position when the first temperature sensor indicates that the engine block temperature is greater than the second predetermined temperature. The cylinder head can thus be cooled prior to cooling of the engine block.

Heating and cooling of the transmission and engine oils can also be controlled by the control system with the use of heat exchangers and a second three-position valve. An engine heat exchanger can be positioned in thermal communication with engine oil in the engine block. A transmission heat exchanger can be placed in thermal communication with transmission oil in the transmission. A second three-position valve can be positioned in the coolant flow passages downstream of the engine block in the coolant flow, operatively connected with the controller. Coolant flow is provided to the engine heat exchanger and is blocked from the transmission heat exchanger when the second three-position valve is in a first position. Coolant flow is provided to the transmission heat exchanger and is blocked from the engine heat exchanger when the second three-position valve is in a second position. Coolant flow is provided to both of the engine heat exchanger and the transmission heat exchanger when the second three-position valve is in the third position.

Optionally, an exhaust heat recovery device heat exchanger (EHRDHE) can be positioned at least partially within the exhaust system and in thermal communication with the coolant flow in the coolant flow passages upstream of the second three-position valve. A bypass valve that has a heat exchange position and a bypass position is operable to direct exhaust flow through the EHRDHE in the heat exchange position and to bypass the EHRDHE in the bypass position. The bypass valve is controlled to be in the heat exchange position when the second three-position valve is in the first position and when the second three-position valve is in the second position, and is controlled to be in the bypass position when the second three-position valve is in the third position.

The powertrain cooling system may also include a radiator operatively connected to the coolant flow passages. A radiator valve may be positioned in the coolant flow passages between the radiator and an inlet of the water pump. The radiator valve is configured to have an open position than permits coolant flow through the radiator and a closed position that prevents coolant flow through the radiator. The radiator valve may be operatively connected to the controller and controlled to be in the closed position in the first and the second of the coolant flow modes. The radiator valve can be controlled to be in the open position in the third coolant flow mode when the second three-position valve is in the third position and the coolant temperature is indicative of the engine oil temperature and the transmission oil temperature being greater than a predetermined maximum oil temperature. The predetermined maximum oil temperature is greater than the predetermined oil temperature.

The powertrain cooling system can also be controlled to assist with heating of the vehicle passenger compartment. Specifically, a passenger compartment heater can be positioned in thermal communication with the coolant flow in the coolant flow passages downstream of the cylinder head and upstream of the second three-position valve. Heat from the coolant is thus used to heat the passenger compartment via the passenger compartment heat exchanger.

A method of cooling a powertrain that has an engine with a cylinder head and an engine block includes controlling a first three-position valve to a first position to block coolant flow to the engine when a temperature of the cylinder head is less than a first predetermined temperature. The first three-position valve is positioned upstream of the engine and downstream of a coolant flow pump. The method further includes controlling the first three-position valve to a second position to direct the coolant flow to the cylinder head and block coolant flow from the engine when the temperature of the cylinder head is greater than the first predetermined temperature and a temperature of the engine block is less than a second predetermined temperature. Under the method, the first three-position valve is controlled to a third position to direct the coolant flow to both the cylinder head and the engine block when the temperature of the engine block is greater than the second predetermined temperature.

The above features and advantages and other features and advantages of the present teachings are readily apparent from the following detailed description of the best modes for carrying out the present teachings when taken in connection with the accompanying drawings.

BRIEF DESCRIPTION OF THE DRAWINGS

FIG. 6 is a schematic illustration in cross-sectional view of the first three-position valve of FIG. 1 in a first position.

FIG. 7 is a schematic illustration in cross-sectional view of the first three-position valve of FIG. 1 in a second position.

FIG. 8 is a schematic illustration in cross-sectional view of the first three-position valve of FIG. 1 in a third position.

FIG. 9 is a schematic illustration in cross-sectional view of the second three-position valve of FIG. 1 in a first position.

FIG. 10 is a schematic illustration in cross-sectional view of the second three-position valve of FIG. 1 in a second position.

FIG. 11 is a schematic illustration in cross-sectional view of the second three-position valve of FIG. 1 in a third position.

DETAILED DESCRIPTION

Figure 1:
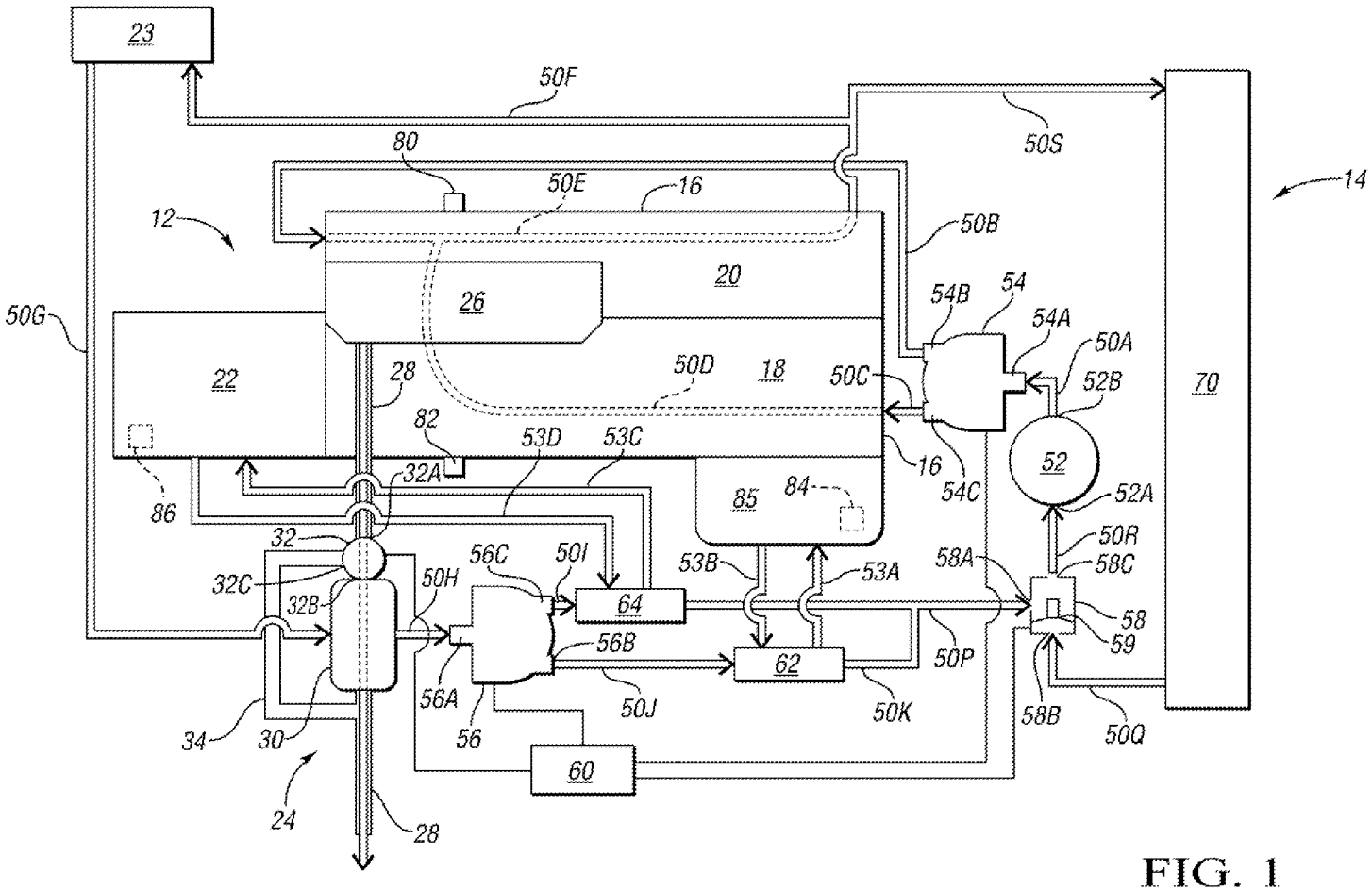
FIG. 1 is a schematic illustration of a powertrain cooling system and a portion of a powertrain, with the cooling system in a first coolant flow mode that has no coolant flow.

Referring to the drawings, wherein like reference numbers refer to like components throughout the several views, FIG. 1 shows a vehicle 10 that has a powertrain 12 and a powertrain cooling system 14 operable in multiple coolant flow modes to increase vehicle efficiency as described herein. The powertrain 12 includes an engine 16 that has an engine block 18 and a cylinder head 20. The powertrain 12 also includes a transmission 22 that is operatively connected to the engine 16 and driven by the engine 16 to propel the vehicle 10. Additionally, the vehicle 10 includes a passenger compartment heater 23 operable to provide heat to a passenger compartment that is in thermal communication with the heater 23. The passenger compartment is not shown, but is well understood in the art as a volume surrounded by the vehicle body in which passengers sit in the vehicle 10. The passenger compartment is adjacent the heater 23, which may be underneath the hood of the vehicle 10 in an engine compartment, so that when air is blown across the heater 23 into the passenger compartment, the air is heated by the heater 23.

The engine 16 has an exhaust system 24 that includes an exhaust manifold 26 mounted to the cylinder head 20. Exhaust gas is discharged from the engine 16 through the exhaust manifold 26 and an exhaust pipe 28 operatively connected thereto. An exhaust heat recovery device heat exchanger (EHRDHE) 30 is positioned in thermal communication with coolant flow in the cooling system 14 and is selectively in thermal communication with the exhaust gas in the exhaust pipe 28 as explained herein. A bypass valve 32 is controllable between two different positions. In a heat exchange position, exhaust gas flows through the EHRDHE 30. When the bypass valve 32 is in a second, bypass position, the exhaust gas flows through a bypass conduit 34 connected to the exhaust pipe 28 to bypass the EHRDHE 30.

The powertrain cooling system 14 is provided to regulate the flow of coolant and to regulate exhaust flow in order to provide warm-up of the components and fluids of the powertrain 12 in the priority most beneficial for fuel efficiency, and then maintain optimal temperatures. The powertrain cooling system 14 includes multiple coolant flow passages 50A, 50B, 50C, 50D, 50E, 50F, 50G, 50H, 50J, 50K, 50P, 50Q, 50R, and 50S through which coolant can be pumped by a pump 52, referred to herein as a water pump or a coolant pump. The coolant flow passages 50A, 50B, 50C, 50D, 50E, 50F, 50G, 50H, 50J, 50K, 50P, 50Q, 50R, and 50S may be conduits or flexible or rigid tubing, or may be bored, drilled, cast or otherwise formed passages in any vehicle component. The pump 52 has an inlet 52A and an outlet 52B. The pump 52 may be driven by the engine 16. Coolant flow through the passages 50A, 50B, 50C, 50D, 50E, 50F, 50G, 50H, 50J, 50K, 50P, 50Q, 50R, and 50S is controlled by multiple valves 54, 56, 58 under the control of a controller 60 to establish different cooling flow modes. The position of the bypass valve 32 is also controlled by the controller 60.

The valve 54 is referred to as a first three-position valve. The valve 54 has an inlet 54A connected to the outlet 52B of the pump 52 by the passage 50A, a first outlet 54B connected to the cylinder head 20 by the passage 50B, and a second outlet 54C connected to the engine block 18 by the passage 50C. The valve 54 is downstream of the pump 52 and upstream of the engine 16 in the direction of coolant flow through the passages 50A, 50B, 50C. The direction of coolant flow, when coolant is permitted to flow by the valve 54, is indicated by arrow heads at the ends of the respective passages 50A-50S. As used herein, a first component is "downstream" of a second component if coolant flows to the first component from the second component during a single circulation loop of the flow circuit, with the flow circuit beginning at the outlet 52B of the pump 52. A first component is "upstream" of a second component if coolant flows from the first component to the second component in a single circulation loop of the flow circuit with the flow circuit beginning at the outlet 52B of the pump 52.

The valve 54 is a rotary valve in the embodiment shown, but may be any type of valve having at least three positions and capable of establishing the flow modes described herein. The valve 54 has an internal movable member 55 that can be controlled by the controller 60 to establish three different positions, as shown in FIGS. 6-8. Coolant flow through the valve 54 is represented by arrows FI for flow into the valve 54 and FO for flow out of the valve 54. The movable member 55 is pivotable about a pivot pin 57. In a first position, shown in FIG. 6, the member 55 blocks the outlets 54B, 54C so that coolant cannot flow through the valve 54. No coolant is thus provided to the engine 16. As shown in FIG. 7, the valve 54 can be rotated in the direction of arrow 59 to a second position in which coolant can flow through the valve 54 from the inlet 54A to the outlet 54B and thus to the cylinder head 20. The valve 54 can be rotated in the direction of arrow 61 to a third position in which coolant can flow through the valve 54, from the inlet 54A to the outlet 54C, as shown in FIG. 8.

Similarly, the valve 56 is a three-position valve and has an inlet 56A, a first outlet 56B and a second outlet 56C. The inlet 56A is connected to the EHRDHE 30 by the coolant passage 50H of FIG. 1. The first outlet 56B is connected to an engine heat exchanger 62 by the passage 50J. The second outlet 56C is connected to a transmission heat exchanger 64 by the coolant passage 50I. The engine heat exchanger 62 is in fluid communication with engine oil in an oil pan 85. Specifically, engine oil is routed through passages 53A and 53B between the engine oil heat exchanger 62 and the oil pan 85 to enable the temperature of the engine oil to be varied by heat transfer with the coolant in the engine heat exchanger 62. The heat exchanger 62 may heat or cool the oil, depending on the relative temperatures of the engine oil and the coolant. Similarly, the transmission oil in the transmission 22 is in thermal communication with the coolant via passages 53C, 53D through which the transmission oil is routed between the transmission 22 and the transmission oil heat exchanger 64. This enables the temperature of the transmission oil to be varied by heat transfer with the coolant in the transmission heat exchanger 64. The heat exchanger 64 may heat or cool the transmission oil, depending on the relative temperatures of the transmission oil and the coolant.

The valve 56 is a rotary valve but may be any type of valve having at least three positions and capable of establishing the flow modes described herein. The valve 56 has an internal movable member 55A that can be controlled by the controller 60 to establish three different positions as shown in FIGS. 9-11. The movable member 55A is pivotable about a pin 57A. The movable member 55A has a first position, shown in FIG. 9, in which the member 55A blocks only the outlet 56C so that coolant can flow through the valve from the inlet 56A to the outlet 56B and thus to the engine heat exchanger 62. The movable member 55A has a second position, shown in FIG. 10, in which the member 55A blocks only the outlet 56B so that coolant can flow through the valve 56 from the inlet 56A to the outlet 56C and thus to the transmission heat exchanger 64. The movable member 55A also has a third position, shown in FIG. 11, in which neither of the outlets 56B, 56C is blocked, so that coolant can flow through the valve 56 from the inlet 56A to both the outlet 56B and the outlet 56C and thereby to both the engine heat exchanger 62 and the transmission heat exchanger 64.

Referring again to FIG. 1, the bypass valve 32 has an inlet 32A connected to the exhaust pipe 28, a first outlet 32B connected to the EHRDHE 30 and a second outlet 32C connected to the bypass conduit 34. The bypass valve 32 is connected to the controller 60, and may be configured as a simple butterfly valve with an internal member movable by the controller 60 to direct the exhaust flow from the inlet 32A to the outlet 32B in a heat exchange position, and to direct the exhaust flow from the inlet 32A to the outlet 32C in a bypass position.

In an alternative embodiment, the bypass valve 32 could be any self-regulating valve that opens and closes automatically in response to temperature. For example, the bypass valve 32 could open in response to an actuator, such as a thermal wax, which is in thermal communication with the coolant and adjusts the valve opening based on the temperature of the coolant and expansion or contraction of the wax which is in contact with the bypass valve 32. The bypass valve 32 could be configured to open automatically at a predetermined coolant temperature.

The radiator valve 58 has a first inlet 58A, a second inlet 58B and an outlet 58C. The outlet 58C of the valve 58 is connected to the inlet 52A of the pump 52 by the passage 50R. An internal member 59 is movable, in response to control signals from the controller 60, from a first position, shown in FIG. 1 to a second position shown in FIG. 5. When the internal member 59 is in the first position, coolant can flow from the first inlet 58A to the outlet 58C and the second inlet 58B is blocked. When the internal member 59 is in the second position, coolant can flow from both the first inlet 58A and the second inlet 58B to the outlet 58C. With the radiator valve in the second position so that the second inlet 58B unblocked, coolant flows through a radiator 70 included in the cooling system 14. Specifically, when the radiator valve 58 is in the second position, coolant can flow from the radiator 70 through passage 50Q. This in turn permits coolant to flow into the radiator 70 from passage 50S. In contrast, when the internal member 59 is in the first position, with the second inlet 58B blocked, coolant cannot flow through the radiator 70, and coolant in the passage 50S is stopped.

In an alternative embodiment, the radiator valve 58 could be any self-regulating valve that opens and closes automatically in response to temperature. For example, the internal member 59 could open in response to an actuator, such as a thermal wax, which adjusts the valve opening based on the temperature of the coolant and expansion or contraction of the wax which is in contact with the movable member 59. The valve 58 could be configured so that the internal member 59 opens automatically at a predetermined coolant temperature.

The powertrain cooling system 14 also includes multiple temperature sensors operatively connected to the controller 60 to provide current temperature conditions in the powertrain 12. For example, a first temperature sensor 80 is mounted to, or in, or is otherwise operatively connected to the cylinder head 20 such that the sensor 80 is in thermal communication with the cylinder head 20 and can provide sensor signals to the controller 60 indicative of a cylinder head temperature. The electrical wiring connecting the sensor 80 to the controller 60 is not shown for purposes of clarity in the drawings.

A second temperature sensor 82 is mounted to, or in, or is otherwise operatively connected to the engine block 18 such that the sensor 82 is in thermal communication with the engine block 18 and can provide sensor signals to the controller 60 indicative of an engine block temperature. The electrical wiring connecting the sensor 82 to the controller 60 is not shown for purposes of clarity in the drawings.

A third temperature sensor 84 is mounted to, or in, or is otherwise operatively connected to the oil pan 85 mounted to the engine block 18 such that the sensor 84 is in thermal communication with engine oil that collects in the oil pan 85 and can provide sensor signals to the controller 60 indicative of an engine oil temperature. The electrical wiring connecting the sensor 84 to the controller 60 is not shown for purposes of clarity in the drawings.

A fourth temperature sensor 86 is mounted to, or in, or is otherwise operatively connected to the transmission 22 such that the sensor 86 is in thermal communication with transmission oil within the transmission 22 and can provide sensor signals to the controller 60 indicative of a transmission oil temperature. The electrical wiring connecting the sensor 86 to the controller 60 is not shown for purposes of clarity in the drawings.

FIG. 1 shows the cooling system 14 in a first cooling mode appropriate for a time period immediately after a cold start of the vehicle 10. In the first cooling mode, the valve 54 is in the first position of FIG. 6 such that fluid flow is not permitted through the valve 54. Because the vehicle 10 has just been started, the coolant will likely be relatively cold, at less than a predetermined coolant temperature at which the radiator valve 58 opens. Accordingly, the radiator valve 58 will be in the closed position, and coolant flow will not be permitted through the radiator 70. An algorithm stored in a processor of the controller 60 is configured so that the controller 60 will open the radiator valve 58 when the temperature of the coolant is above a predetermined coolant temperature. The coolant temperature may be indicated by association with the engine block temperature determined by the sensor 82. The coolant temperature at which the radiator valve 58 opens may be indicative of an engine oil temperature and a transmission oil temperature above a predetermined maximum oil temperature. Accordingly, the radiator valve 58 opens to allow the coolant to flow through the radiator 70 only after the engine oil and the transmission oil are sufficiently warmed.

In the first cooling flow mode of FIG. 1, the bypass valve 32 is in the heat exchange position, and the valve 56 is in the first position. However, because the valve 54 is in the first position, cooling flow is stopped throughout the cooling system. Without circulation of the coolant, the cylinder head 20, the engine block 18, the engine oil and the transmission oil will all increase in temperature during this mode.

Figure 2:
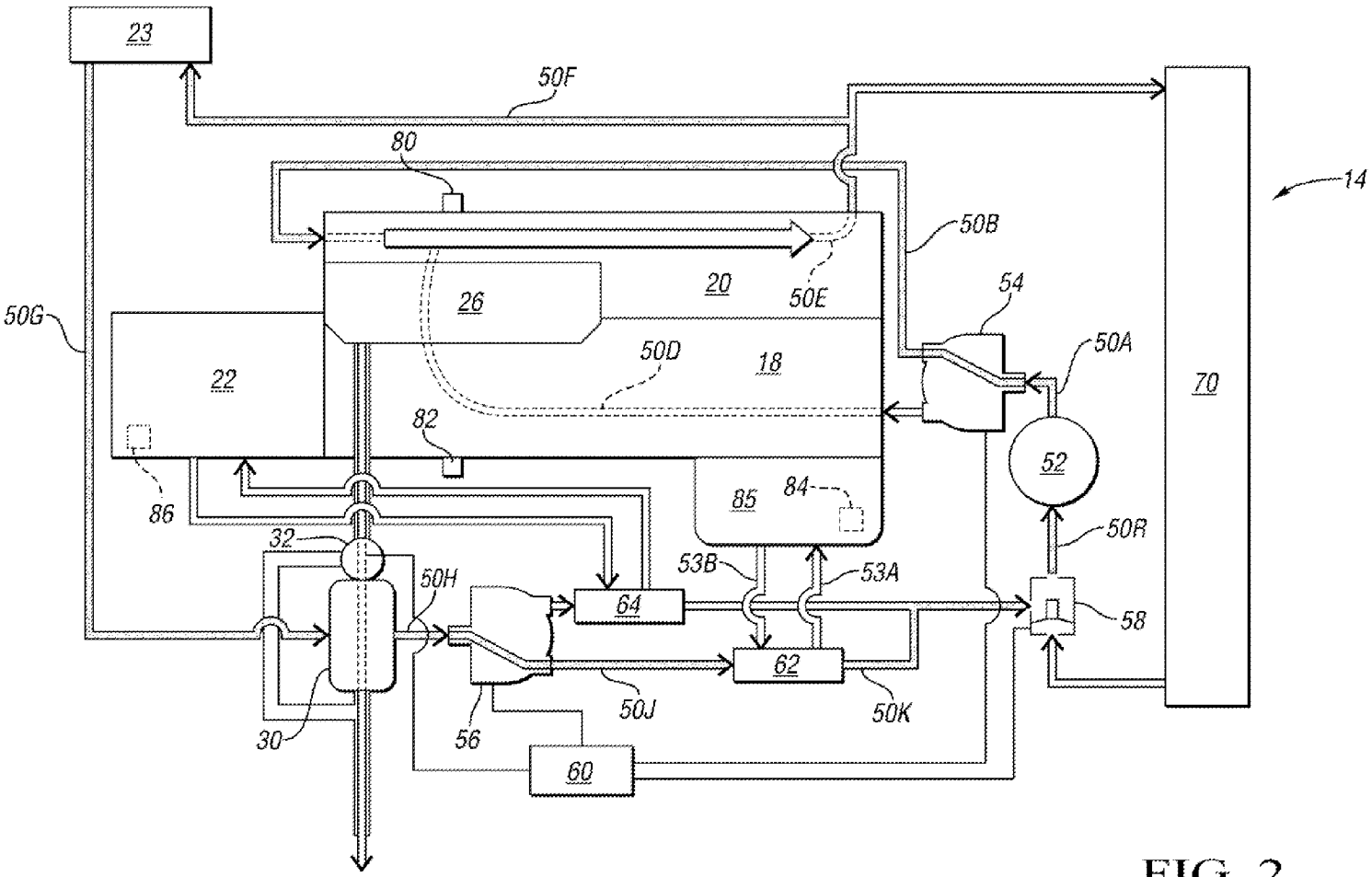
FIG. 2 is a schematic illustration of the powertrain cooling system and powertrain of FIG. 1, with the powertrain cooling system in a second coolant flow mode with coolant flow to a cylinder head of the engine and to an engine heat exchanger, with an exhaust heat recovery device heat exchanger in a heat exchange mode, and with no coolant flow through a radiator.

When the first temperature sensor 80 indicates that the temperature of the cylinder head 20 is greater than a first predetermined temperature, and the second temperature sensor 82 indicates that the temperature of the engine block 18 is less than a second predetermined temperature, the controller 60 will establish a second cooling flow mode by placing the valve 54 in the second position of FIG. 7 to permit coolant to flow through the cylinder head 20 as indicated in FIG. 2. The first predetermined temperature is selected as an optimal cylinder head temperature. The second predetermined temperature is selected as an optimal engine block temperature. The valves 32 and 56 remain in the same positions as in the first cooling flow mode. The radiator valve 58 is also in the closed position, because the cylinder head temperature at which the valve 54 is placed in the second position is associated with an engine oil temperature and coolant temperature significantly less than that at which the valve 58 is moved to the open position.

With the valve 54 in the second position, pumped coolant flows through the cylinder head 20, to the heater 23, through the EHRDHE 30, and through the engine heat exchanger 62 through passages 50A, 50B, 50E, 50F, 50G, 50H, 50J, 50K and 50R. In this flow mode, the coolant will extract heat from the cylinder head 20, provide heat at the heater 23, pickup additional heat in the EHRDHE 30, and provide heat at the engine heat exchanger 62 to heat the engine oil in the oil pan 85. The transmission oil is not initially heated by the transmission heat exchanger 64, as coolant does not flow to the transmission heat exchanger 64 at the outset of the second cooling flow mode. However, once the engine oil is heated to a predetermined temperature, the second three-position valve 56 can be controlled to move to the second position of FIG. 10 so that coolant flows to the transmission heat exchanger 64 to heat the transmission oil. The valve 56 is controlled based on temperatures indicated by the temperature sensors 84, 86 so the engine oil and the transmission oil are heated in stages during the second cooling flow mode to provide maximal friction reduction benefits.

During the second cooling flow mode, the controller 60 continues to receive sensor signals from the temperature sensors indicative of sensed temperature conditions as described above. When the second temperature sensor 82 indicates that the temperature of the engine block 18 is greater than the second predetermined temperature, the controller 60 places the valve 54 in the third position, so that coolant flows to the engine block 18 and then to the cylinder head 20 in a U-formation through the passages 50D and 50E. The internal passages in the engine block 18, represented by passage 50D, are in continuous fluid communication with the internal passages of the cylinder head 20, represented by passage 50E creating a U-formation. It should be appreciated that the internal passages in the engine block 18 and the internal passages in the cylinder head 20 may be configured to be in fluid communication with one another in formations other than a U-formation. That is, the passages 50D, 50E may be configured in other than a U-formation.

When the valve 54 is in the second position of FIGS. 2 and 7, coolant in the passage 50D is relatively stagnant, and is not affected by the coolant flow through the passage 50E. Coolant flow through the passage 50D with the valve 54 in the third position will force coolant to flow to passage 50E and then to passage 50F. The valve 32 remains in the exhaust heat recovery position.

Figure 3:
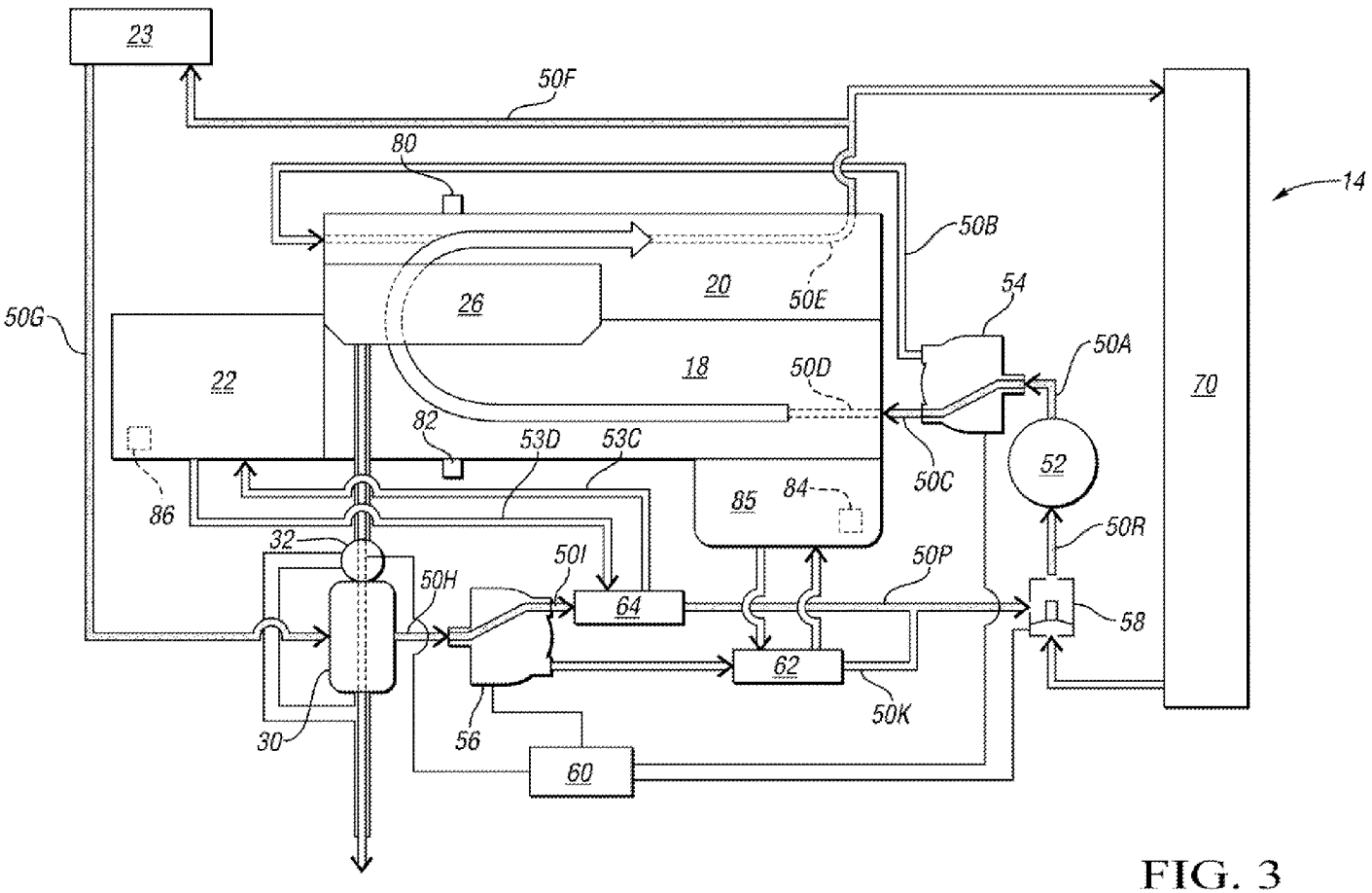
FIG. 3 is a schematic illustration of the powertrain cooling system and powertrain of FIG. 1, with the powertrain cooling system in a third coolant flow mode with coolant flow to both an engine block and the cylinder head of the engine and to a transmission heat exchanger, with the exhaust heat recovery device heat exchanger in a heat exchange mode, and with no coolant flow through a radiator.
Figure 4:
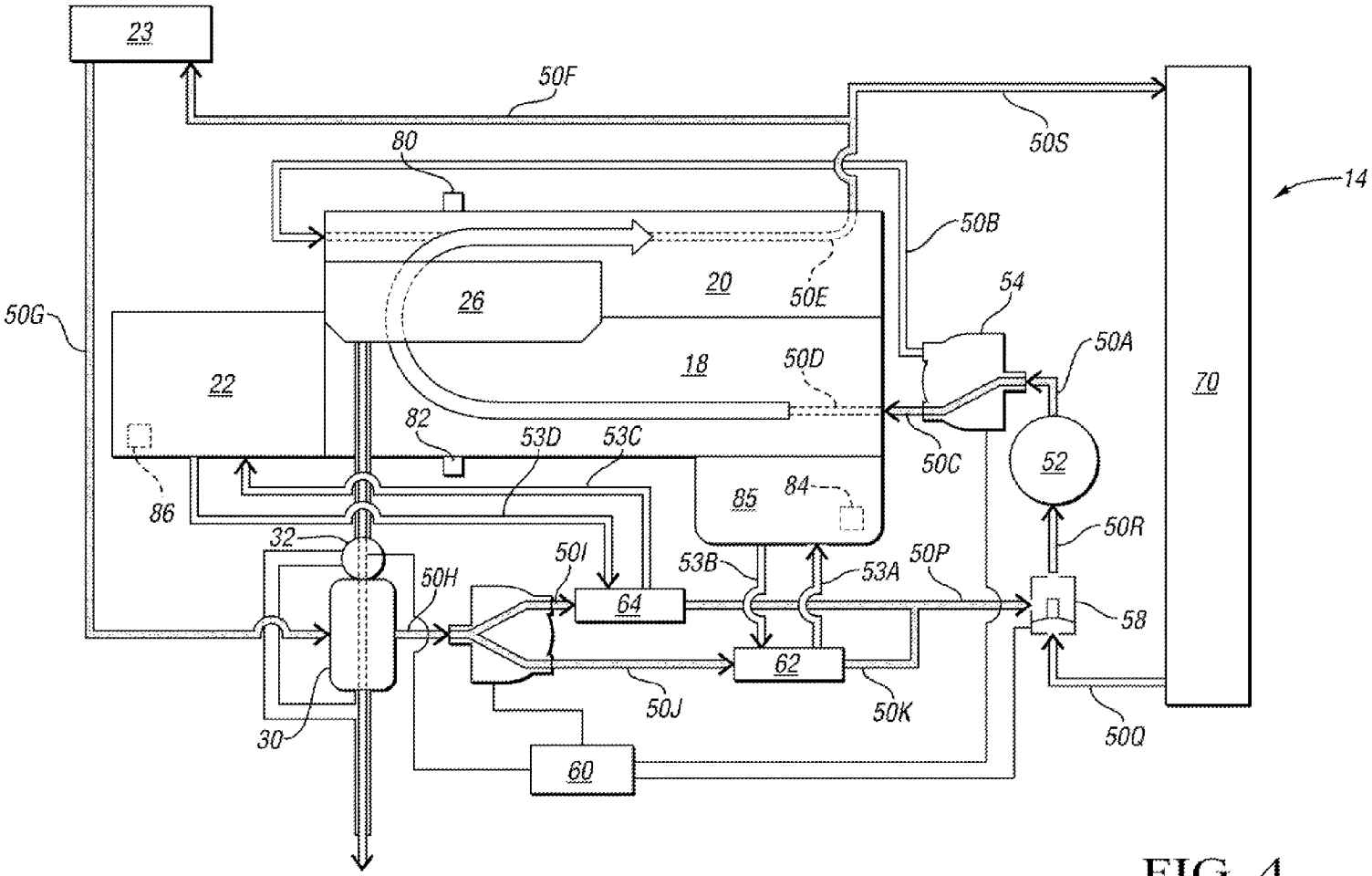
FIG. 4 is a schematic illustration of the powertrain cooling system and powertrain of FIG. 1, with the powertrain cooling system in a fourth coolant flow mode with coolant flow to both an engine block and the cylinder head of the engine, to both the engine heat exchanger and the transmission heat exchanger, with the exhaust heat recovery device heat exchanger in a heat exchange mode, and with no coolant flow through a radiator.

During the third cooling flow mode, the valve 56 is controlled to establish staged heating of the engine oil and the transmission oil by moving between the first and second positions. FIG. 3 shows one of these stages, with the valve 56 in the second position. Once optimum oil temperatures are reached, the valve 56 is moved to the third position of FIG. 11, as shown in FIG. 4, so that coolant is provided to both the engine heat exchanger 62 and the transmission heat exchanger 64 simultaneously to maintain oil temperature at the optimal, predetermined oil temperature via the heat exchangers 62, 64. Coolant thus flows in a circuit in the third cooling flow mode, through the engine block 18, the cylinder head 20, the heater 23, the EHRDHE 30, and either or both of the engine heat exchanger 62 and the transmission heat exchanger 64 through passages 50A, 50C, 50D, 50E, 50F, 50G, 50H, 50I, 50J, 50K, 50P and 50R.

Figure 5:
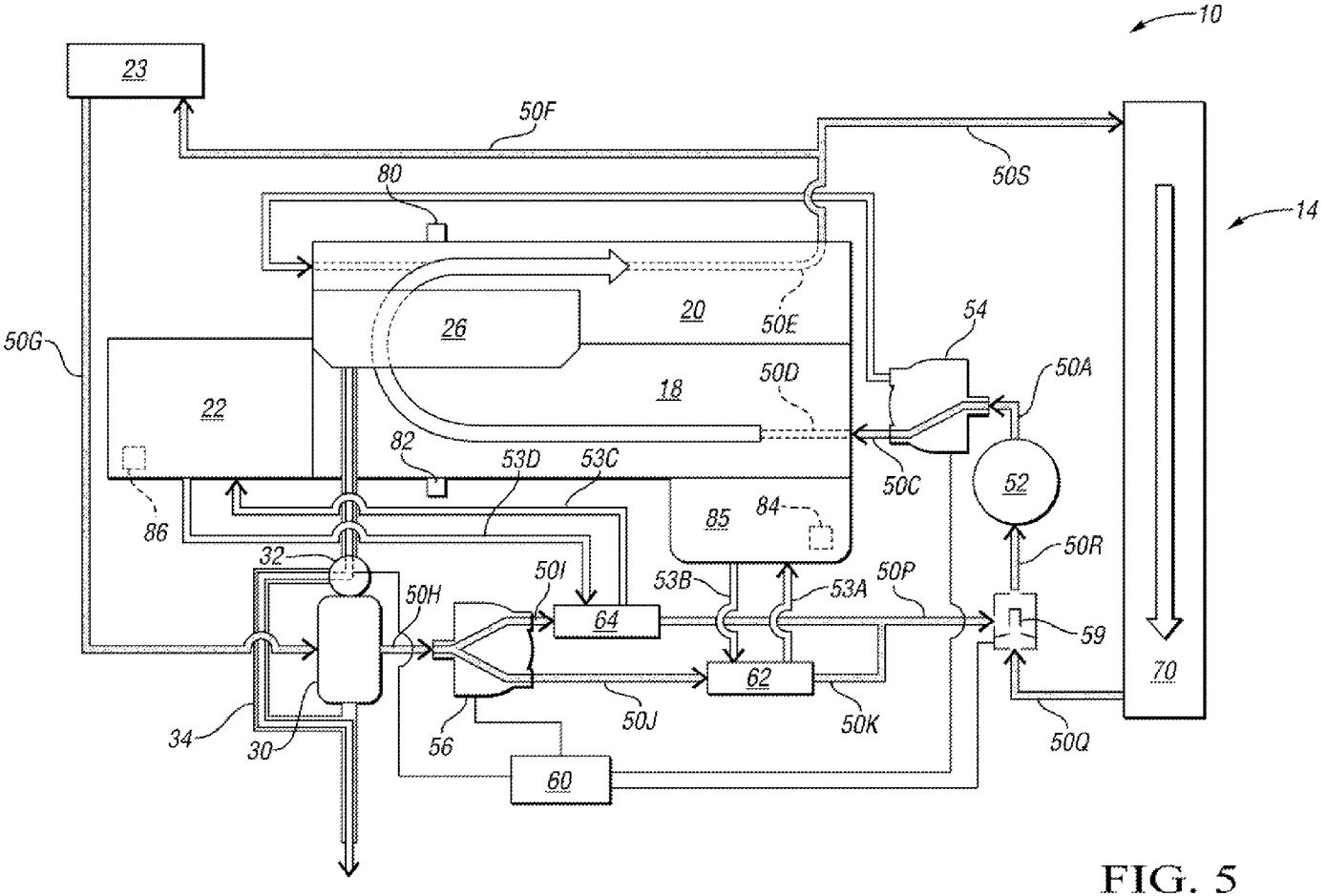
FIG. 5 is a schematic illustration of the powertrain cooling system and powertrain of FIG. 1, with the powertrain cooling system in a fifth coolant flow mode with coolant flow to both an engine block and the cylinder head of the engine, to both the engine heat exchanger and the transmission heat exchanger, with the exhaust heat recovery device heat exchanger in a bypass mode and with coolant flow through a radiator.

Exhaust heat recovery and coolant flow to the engine heat exchanger 62 and the transmission heat exchanger 64 continues until oil temperatures are consistent with maximum frictional benefits. Once the temperature sensors 84, 86 indicate that a predetermined maximum oil temperature at which maximum frictional benefits are achieved has been reached, a fourth cooling flow mode is established as shown in FIG. 5, as the valve 32 is moved to a bypass position and the radiator valve 58 is moved to an open position. The controller 60 moves the valve 58 to an open position when a coolant temperature consistent with the maximum oil temperatures is reached, with the coolant temperature being determined by the controller 60 based on engine block temperature. Coolant can then flow through the radiator 70 to exhaust additional heat. The valve 54 remains in the third position and the valve 56 remains in its third position. In the fourth cooling flow mode, coolant flows in a circuit through passages 50A, 50C, 50D, 50E, splitting through 50F and 50S. Flow from passage 50F continues through the heater 23, through passage 50G, through the EHRDHE 30 (which the exhaust gas bypasses through conduit 34), is split through passage 50I and 50J, flows through passage 50P or 50K and then to 50R. The coolant that split to passage 50S flows through the radiator 70 to passage 50Q and through the radiator valve 58 to the passage 50R and back through the pump 52.

A method of cooling a powertrain 12 that has an engine 16 with a cylinder head 20 and an engine block 18 thus includes controlling a first three-position valve 54 to a first position to block coolant flow to the engine block 18 when a temperature of the cylinder head 20 is less than a first predetermined temperature. The method further includes controlling the first three-position valve 54 to a second position to direct the coolant flow to the cylinder head 20 and block coolant flow from the engine block 18 when the temperature of the cylinder head 20 is greater than the first predetermined temperature and a temperature of the engine block 18 is less than a second predetermined temperature The method then includes controlling the first three-position valve 54 to a third position to direct the coolant flow to both the cylinder head 20 and the engine block 18 when the temperature of the engine block 18 is greater than the second predetermined temperature.

The method may include controlling a second three-position valve 56 that is downstream of the engine 16 to a first position to direct the coolant flow to an engine heat exchanger 62 when an engine oil temperature is less than a predetermined engine oil temperature. The second three-position valve 56 can then be controlled to a second position to direct the coolant flow to a transmission heat exchanger 64 when a transmission oil temperature is less than a predetermined transmission oil temperature and the engine oil temperature is greater than the predetermined engine oil temperature. The method may then include controlling the second three-position valve 56 to a third position to direct the coolant flow to both the engine heat exchanger 62 and the transmission heat exchanger 64 when the transmission oil temperature is greater than a predetermined transmission oil temperature and the engine oil temperature is greater than the predetermined engine oil temperature. The predetermined transmission oil temperature may be the same as the predetermined engine oil temperature.

Additionally, an exhaust heat recovery bypass valve 32 may be controlled under the method to direct engine exhaust so that it is in thermal communication with the coolant flow when the second three-position valve 56 is in the first position or in the second position. The exhaust heat recovery bypass valve 32 may be controlled so that the engine exhaust bypasses thermal communication with the coolant flow when the second three-position valve 56 is in the third position. A radiator valve 58 may be positioned in the coolant flow downstream of the engine heat exchanger 62 and the transmission heat exchanger 64, upstream of an inlet 52A of the coolant pump 52, and downstream of a radiator 70. Under the method, the valve 58 may be controlled to maintain a closed position in which coolant flow from the radiator 70 is blocked from the inlet 52A of the pump 50, shown in FIG. 1, thereby stopping coolant flow through the radiator 70. The valve 58 may be controlled to maintain an open position, in which coolant flow from the radiator 70 is permitted through the radiator valve 58 to the inlet 52A of the coolant pump 52. The radiator valve 58 may be configured to permit coolant flow from the engine heat exchanger 62 and the transmission heat exchanger 64 to pass through the valve 58 in both the closed position and the open position.

While the best modes for carrying out the many aspects of the present teachings have been described in detail, those familiar with the art to which these teachings relate will recognize various alternative aspects for practicing the present teachings that are within the scope of the appended claims.

The invention claimed is:

1. A powertrain cooling system for a powertrain that has an engine with a cylinder head and an engine block and has a transmission connected to the engine, the powertrain cooling system comprising:

a coolant pump;

a plurality of coolant flow passages;

a first three-position valve operatively connected with an outlet of the coolant pump and having a first, a second, and a third position to at least partially establish different coolant flow modes through the coolant flow passages;

wherein coolant flow from the coolant pump is blocked from both the cylinder head and the engine block in a first of the coolant flow modes when the three-position valve is in the first position; wherein coolant flow from the coolant pump is provided to the cylinder head and is blocked from the engine block in a second of the coolant flow modes when the three-position valve is in the second position; wherein coolant flows from the coolant pump to the engine block and from the engine block to the cylinder head in a third of the coolant flow modes when the three-position valve is in the third position;

a first temperature sensor in thermal communication with the cylinder head to indicate a cylinder head temperature;

a second temperature sensor in thermal communication with the engine block to indicate an engine block temperature;

a controller operatively connected to the first three-position valve and to the temperature sensors;

wherein the controller is configured to place the first three-position valve in the first position when the first temperature sensor indicates the cylinder head temperature is less than a first predetermined temperature; wherein the controller is configured to place the first three-position valve in the second position when the first temperature sensor indicates that the cylinder head temperature is greater than the first predetermined temperature and the engine block temperature is less than a second predetermined temperature; and wherein the controller is configured to place the first three-position valve in the third position when the first temperature sensor indicates that the engine block temperature is greater than the second predetermined temperature;

an engine heat exchanger in thermal communication with engine oil in the engine block;

a transmission heat exchanger in thermal communication with transmission oil in the transmission;

a second three-position valve positioned in the coolant flow passages downstream of the engine block in the coolant flow, operatively connected with the controller, and having a first position, a second position, and a third position;

wherein coolant flow is provided to the engine heat exchanger and is blocked from the transmission heat exchanger when the second three-position valve is in the first position;

wherein coolant flow is provided to the transmission heat exchanger and is blocked from the engine heat exchanger when the second three-position valve is in the second position;

wherein coolant flow is provided to both of the engine heat exchanger and the transmission heat exchanger when the second three-position valve is in the third position;

a third temperature sensor in thermal communication with engine oil in the engine block and operatively connected with the controller to indicate an engine oil temperature;

a fourth temperature sensor in thermal communication with transmission oil in the transmission and operatively connected with the controller to indicate a transmission oil temperature;

wherein the controller is configured to place the second three-position valve in the first position when the engine oil temperature is less than a predetermined oil temperature;

wherein the controller is configured to place the second three-position valve in the second position when the engine oil temperature is greater than the predetermined oil temperature and the transmission oil temperature is less than the predetermined oil temperature; and wherein the second three-position valve is in the third position when the engine oil temperature and the transmission oil temperature are greater than the predetermined oil temperature.

2. The powertrain of claim 1, wherein the second three-position valve is in the first position or the second position during the second of the coolant flow modes; and wherein the second three-position valve is in the third position during the third of the coolant flow modes.

3. The powertrain cooling system of claim 1, further comprising:

an exhaust system through which exhaust gas is discharged from the engine;

an exhaust heat recovery device heat exchanger (EHRDHE) positioned at least partially within the exhaust system and in thermal communication with the coolant flow in the coolant flow passages upstream of the second three-position valve;

a bypass valve having a heat exchange position and a bypass position and operable to direct exhaust flow through the EHRDHE in the heat exchange position and to bypass the EHRDHE in the bypass position;

wherein the bypass valve is in the heat exchange position when the second three-position valve is in the first position and when the second three-position valve is in the second position; and wherein the bypass valve is in the bypass position when the second three-position valve is in the third position.

4. The powertrain cooling system of claim 3, further comprising:

a radiator operatively connected to the coolant flow passages;

a radiator valve positioned in the coolant flow passages between the radiator and an inlet of the water pump; wherein the radiator valve is configured to have an open position than permits coolant flow through the radiator and a closed position that prevents coolant flow through the radiator;

wherein the radiator valve is in the closed position in the first and the second of the coolant flow modes; and wherein the radiator valve is in the open position in the third coolant flow mode when the second three-position valve is in the third position and the coolant temperature is indicative of the engine oil temperature and the transmission oil temperature being greater than a predetermined maximum oil temperature that is greater than the predetermined oil temperature.

5. The powertrain cooling system of claim 3, further comprising:

a passenger compartment heater positioned in thermal communication with the coolant flow in the coolant flow passages downstream of the cylinder head and upstream of the second three-position valve.

6. A powertrain cooling system for a powertrain that has an engine with a cylinder head and an engine block, and a transmission connected to the engine, wherein engine oil is in the engine and transmission oil is in the transmission, the powertrain cooling system comprising:

a coolant pump;

a plurality of coolant flow passages;

a controller;

a first three-position valve downstream of the coolant pump and upstream of the engine in the coolant flow passages, operatively connected to the controller and having three different positions to selectively interconnect an outlet of the coolant pump with one, both or neither of the cylinder head and the engine block through the coolant flow passages to at least partially establish different coolant flow modes;

an engine heat exchanger in thermal communication with engine oil in the engine block;

a transmission heat exchanger in thermal communication with transmission oil in the transmission;

a second three-position valve positioned in the coolant flow passages downstream of the engine block in the coolant flow, operatively connected with the controller and having three different positions to selectively interconnect the coolant flow with only the engine heat exchanger, with only the transmission heat exchanger or with both of the engine heat exchanger and the transmission heat exchanger to further establish the different coolant flow modes; and wherein the controller is configured to control the first and the second three-position valves to the three different positions, respectively, to first warm the engine, and then warm the transmission oil.

7. The powertrain cooling system of claim 6, further comprising:

an exhaust system through which exhaust gas is discharged from the engine;

an exhaust heat recovery device heat exchanger (EHRDHE) positioned at least partially within the exhaust system and in thermal communication with the coolant flow in the coolant flow passages upstream of the second three-position valve;

a bypass valve having a heat exchange position and a bypass position and operable to direct the exhaust flow across the EHRDHE in the heat exchange position and to bypass the EHRDHE in the bypass position;

wherein the bypass valve is in the heat exchange position both when the engine oil temperature is greater than a predetermined oil temperature and the transmission oil temperature is less than the predetermined oil temperature; and wherein the bypass valve is in the bypass position when the engine oil temperature and the transmission oil temperature are greater than the predetermined oil temperature.

8. The powertrain cooling system of claim 6, further comprising:

a radiator operatively connected to the coolant flow passages;

a radiator valve positioned in the coolant flow passages between the radiator and an inlet of the water pump and operatively connected to the controller; wherein the radiator valve is configured to have an open position than permits coolant flow through the radiator and a closed position that prevents coolant flow through the radiator;

wherein the radiator valve is in the open position only when the engine block temperature is greater than a predetermined engine block temperature.

9. The powertrain cooling system of claim 6, further comprising:

a passenger compartment heater positioned in thermal communication with the coolant flow in the coolant flow passages downstream of the cylinder head and upstream of the second three-position valve.

10. A method of cooling a powertrain that has an engine with a cylinder head and an engine block, comprising:

controlling a first three-position valve to a first position to block coolant flow to the engine when a temperature of the cylinder head is less than a first predetermined temperature; wherein the first three-position valve is positioned upstream of the engine and downstream of a coolant flow pump;

controlling the first three-position valve to a second position to direct the coolant flow to the cylinder head and block coolant flow from the engine when the temperature of the cylinder head is greater than the first predetermined temperature and a temperature of the engine block is less than a second predetermined temperature;

controlling the first three-position valve to a third position to direct the coolant flow to both the cylinder head and the engine block when the temperature of the engine block is greater than the second predetermined temperature;

controlling a second three-position valve to a first position to direct the coolant flow to an engine heat exchanger when an engine oil temperature is less than a predetermined oil temperature; wherein the second three-position valve is downstream of the engine in the coolant flow;

controlling the second three-position valve to a second position to direct the coolant flow to a transmission heat exchanger when a transmission oil temperature is less than a predetermined oil temperature and the engine oil temperature is greater than the predetermined oil temperature;

controlling the second three-position valve to a third position to direct the coolant flow to both the engine heat exchanger and the transmission heat exchanger when the transmission oil temperature is greater than the predetermined oil temperature;

controlling an exhaust heat recovery bypass valve to direct engine exhaust in thermal communication with the coolant flow when the second three-position valve is in the first position or in the second position; and controlling the exhaust heat recovery bypass valve so that the engine exhaust bypasses thermal communication with the coolant flow when the second three-position valve is in the third position.

11. The method of claim 10, further comprising:

positioning a radiator valve in the coolant flow downstream of the engine heat exchanger and the transmission heat exchanger, upstream of an inlet of the coolant pump and downstream of a radiator;

wherein the radiator valve is configured to maintain a closed position in which coolant flow from the radiator is blocked from the inlet of the pump, thereby stopping coolant flow through the radiator, and to maintain and open position in which coolant flow from the radiator is permitted through the radiator valve to the inlet of the coolant pump; and wherein the radiator valve is configured to permit coolant flow from the engine heat exchanger and the transmission heat exchanger in both the closed position and the open position.

* * * * *